US010124935B1

(12) United States Patent
Morris, Jr.

(10) Patent No.: US 10,124,935 B1
(45) Date of Patent: Nov. 13, 2018

(54) OPEN END CONTAINER WITH RESEALABLE LID ASSEMBLY

(71) Applicant: Glenn H. Morris, Jr., Chattanooga, TN (US)

(72) Inventor: Glenn H. Morris, Jr., Chattanooga, TN (US)

( * ) Notice: Subject to any disclaimer, the term of this patent is extended or adjusted under 35 U.S.C. 154(b) by 307 days.

(21) Appl. No.: 14/956,441

(22) Filed: Dec. 2, 2015

Related U.S. Application Data

(60) Provisional application No. 62/090,477, filed on Dec. 11, 2014.

(51) Int. Cl.
*B65D 43/02* (2006.01)
*B65D 53/02* (2006.01)

(52) U.S. Cl.
CPC ..... *B65D 43/0277* (2013.01); *B65D 53/02* (2013.01); *B65D 2543/00972* (2013.01)

(58) Field of Classification Search
CPC ..... B65D 43/0277; B65D 53/02; B65D 2543/00972
USPC ..... 220/265, 266, 276
See application file for complete search history.

(56) References Cited

U.S. PATENT DOCUMENTS 6,170,691 B1 * 1/2001 Morris, Sr. ..... B65D 21/0219 206/508
2001/0010311 A1 * 8/2001 Ciccone ..... B65D 43/0256 220/276
2015/0353241 A1 * 12/2015 Glaser ..... B65D 43/0277 215/252

* cited by examiner

*Primary Examiner* — James N Smalley
*Assistant Examiner* — Madison L Poos
(74) *Attorney, Agent, or Firm* — Stephen J. Stark; Miller & Martin PLLC

(57) ABSTRACT

An open ended container and lid combination provides a tamper indicator with a lid and container combination which can be pushed on by a manufacture and then the tamper indicator removed to allow the lid to be unscrewed relative to the container, while also still being able to be screwed back to a closed, and possibly sealed configuration. Two possible seals may be used comprising a seal against an interior surface of an upwardly extending wall of the container and an extension/groove combination of the lid and container.

19 Claims, 3 Drawing Sheets

OPEN END CONTAINER WITH RESEALABLE LID ASSEMBLY

CLAIM OF PRIORITY

This application claims the benefit of U.S. Provisional Patent Application No. 62/090,477 filed Dec. 11, 2014 which is incorporated herein by reference in its entirety.

FIELD OF THE INVENTION

This application is directed to a open end container with a resealable lid assembly.

BACKGROUND OF THE INVENTION

For years the applicant has been requested to provide a five gallon and possibly other sized pail with a lid that can reseal itself. Some applications could be directed to keeping paint fresh or other applications such as, but not limited to, those in which part of the contents were utilized but not all at once so that the remainder of the contents could be kept fresh for later use.

Additionally, a number of years ago, the applicant obtained U.S. Pat. No. 6,170,691 which has a seal located on an interior wall of the container. That technology is still in use today for particularly robust applications. However, new technology is believed to be useful for still further applications.

SUMMARY OF THE INVENTION

Accordingly, it is an object of many embodiments of the invention to provide a lid and container assembly. The lid can be configured to be initially applied by a manufacturer to seal contents therein such as paint, chemicals or other components therein whereby the ingredients are ready for shipment. A tear-off strip with an internally directed hook (which can protect the seal) can be provided below internally directed threads of outer inwardly directed wall of the lid.

In the prior art, a narrow internally directed satellite ring extended cantileveredly inwardly relative to the lid to provide the hook would engage below an outwardly and downwardly bent lip of a container to provide the retention until a tear strip was removed below the hook which then allowed the hook to be pried radially outwardly away from the container to allow access so that the lid could be removed from the container. However, once this process was performed, the lid could not easily be resealed relative to the container. Lids can be pounded back on, but typically do not form an airtight seal when such action is performed. Knocked over pails can then leak their contents or their contents could otherwise degrade in quality (i.e., dry out) due to unwanted air intrusion into the container.

However, the applicant's new design is believed to provide a pail having an improved open end construction providing what is believed to be a unique construction which preferably cooperates with at least one set of threads on a lid as well as receive the hook therebelow so that once the hook seal is removed with the removal of a tear strip so the threads of the lid could then still engage at least a channel if not corresponding threads of a container on the lip so that the lid may be screwed on and off and in this process resealed relative to the contents internal to the container.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
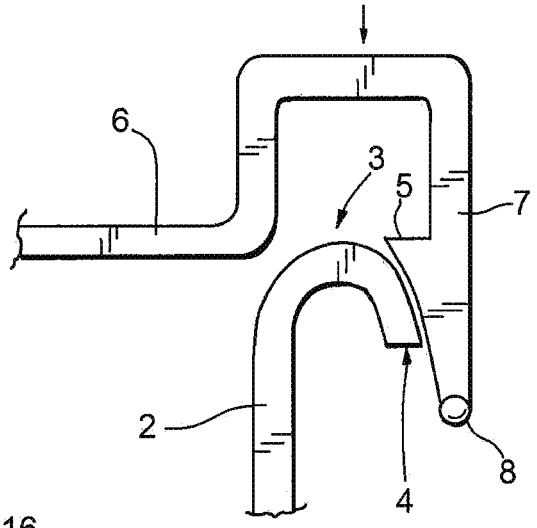
FIG.1 PRIOR ART
FIG. 1 shows a cross sectional view of a prior art container and lid construction in the process of being connected together.

FIG. 1 shows a prior art pail and lid construction in cross sectional form. Container 2 is shown with upper end 3 providing a downwardly curved lip 4 which is about to receive inwardly directed hook 5 from lid 6 located on downwardly extending wall 7. As one of ordinary skill in the art would understand, the lid 6 is pressed downwardly onto the container 2 so that the hook 5 would then be retained from upward movement relative to the lip 4 and provides a seal. This seal works satisfactory until a tear strip is removed at a bottom 8 of the downwardly extending wall 7. The downwardly extending wall 7 with hook 5 is then bent or pried radially outwardly away from the container 2 (and lip 4) thus breaking the seal and allowing the lid 6 to be upwardly removed from the container 2. This design has worked satisfactory for pails of paint, drywall and other uses for years.

Figure 2:
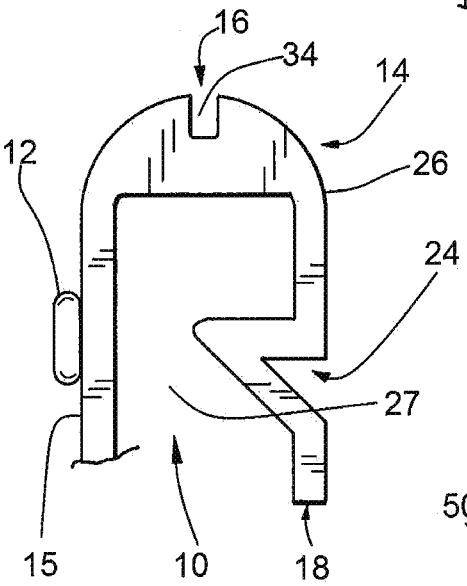
FIG. 2 shows a cross section of an improved container construction.
Figure 3:
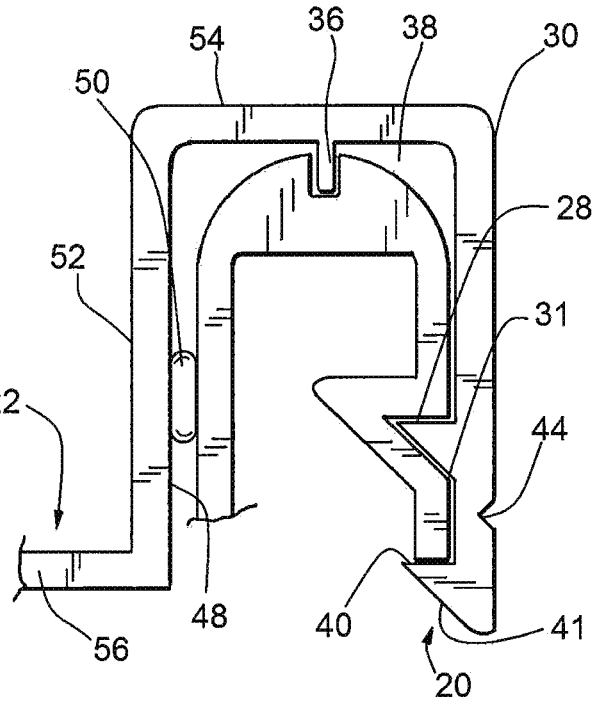
FIG. 3 shows a cross sectional view of the container showed in FIG. 2 together with a cooperating portion of a lid connected thereto.

However, what if all the contents are not utilized? Paint and drywall dry out or degrade once the lid is initially removed from the pail. An improved design is believed to be desirable for such an embodiment and other embodiments. And to that effect, FIG. 2 shows a portion of the container 10 having an internal seal 12. The container 10 has what is believed to be a new lip 14 construction which is quite different than prior art designs. At the upper end 16 of upwardly extending walls 15 of container 10, the lip 14 may have a bottom end 18 which can cooperate with a hook 20 of a lid 22 as shown in FIG. 3 when installed. Unlike the prior art design, the hook 20 is removed with the removal of the tear strip, not just freed to be pried away from the container in sections.

In addition, a thread 24 shown as a channel in downwardly extending and outwardly facing wall 26 of container 10 (spaced by gap 27 radially outwardly from upwardly extending wall 15) is provided which can cooperate with an internally directed thread 28 of the downwardly extending wall 30 of the lid 22. Additionally, groove 34 may be provided to receive extension 36 for at least some embodiments as will be explained in further detail below. Operation of the lid 22 relative to the container 10 will also be explained in further detail below to form a first seal.

When a new container 10 is provided and a new lid 22 is provided, the lid can be positioned in a desired position relative to the container and set there on top with a channel 38 of lid 22 disposed directly above the upper end 16 of the container 10. As was done in the prior art, the lid 22 can then press downwardly so that the hook 40 passes downwardly past the bottom end of the lip 18 for an initial seal with angled surface 41 assisting in this process. However, when doing this, the threads 28 with angled surface 31 also pass along wall 26 and into channel 24. Aligning of the lid 22 relative to the container may be done, such as within tolerances, and/or by varying the width W of channel shown in FIG. 8. Hook 40 may be disposed radially inwardly along wall 30 relative to threads 28 as shown or at the same radial extent or radially outwardly relative thereto for various embodiments.

Figure 9:
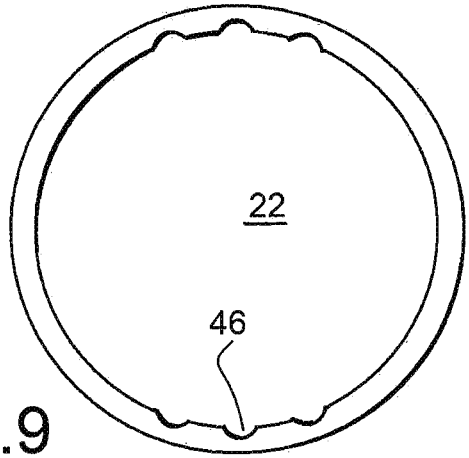
FIG. 9 is a top plan view of the lid shown in FIG. 7.
Figure 7:
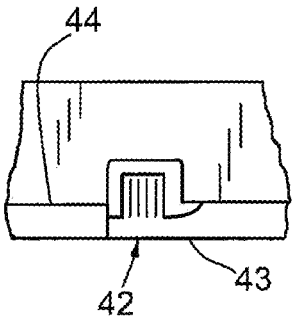
FIG. 7 shows an external side view of the lid prior to removing the tear strip.
Figure 8:
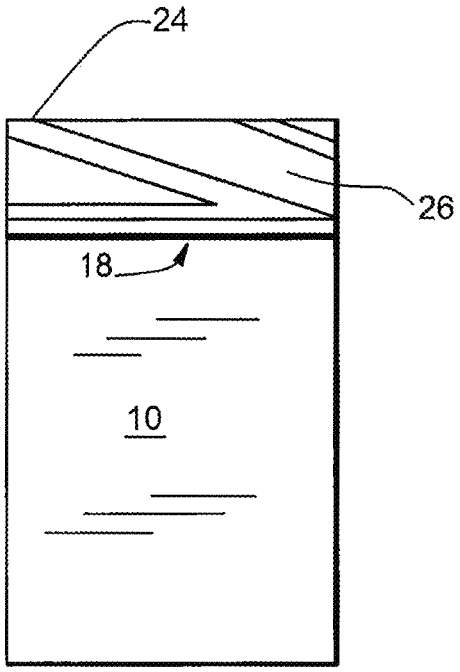
FIG. 8 shows an external plan view of the container shown in FIG. 3.

In order to access the contents for the first time the tear strip 42 is partially removed which as shown in FIG. 7 removes the hook 40 such as by removing at demarcation line 44 as shown in reference to FIGS. 3 and 7. With the tear strip 42 removed, then threads 28 can be twisted and/or channel 24 by gripping portions 46 on an upper surface of the lid 26 such as shown in FIG. 9 and rotating the lid 22 relative to the container 10 to remove it. When reversing this process of engaging threads with channel 24, the internal surface 48 of lid 22 can form a first seal (or second if the extension 36 is in the groove 34 forming a first seal) with gasket 50 is as the threads 28 engaging the channel 24 and rotate. Channel 24 could also be corresponding threads and possibly form a thread or channel 24 as shown in FIG. 8 so that when the process is reversed the gasket 50 is compressed and therefore preferably provides an air-tight seal internal to the container 10 with the lid 22 attached. The gasket 50 is preferably compressed radially as the threads 28 engage by rotation with the channel 24 (or threads) linearly along a rotation axis perpendicular to the radial compression plane of the gasket 50.

Figure 5:
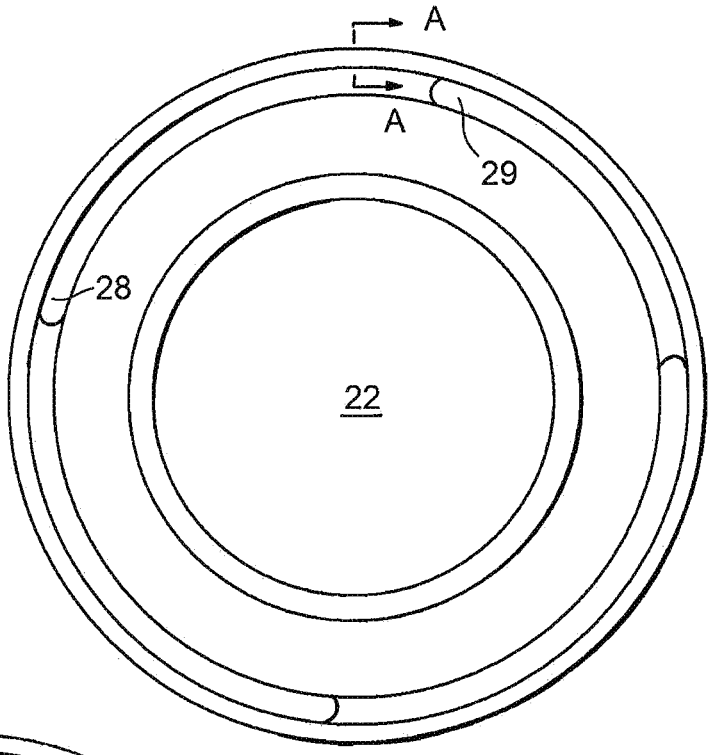
FIG. 5 shows a bottom plan view of the lid shown in FIGS. 3 and 4 with the tear strip removed with portion A-A being shown in detail.
Figure 4:
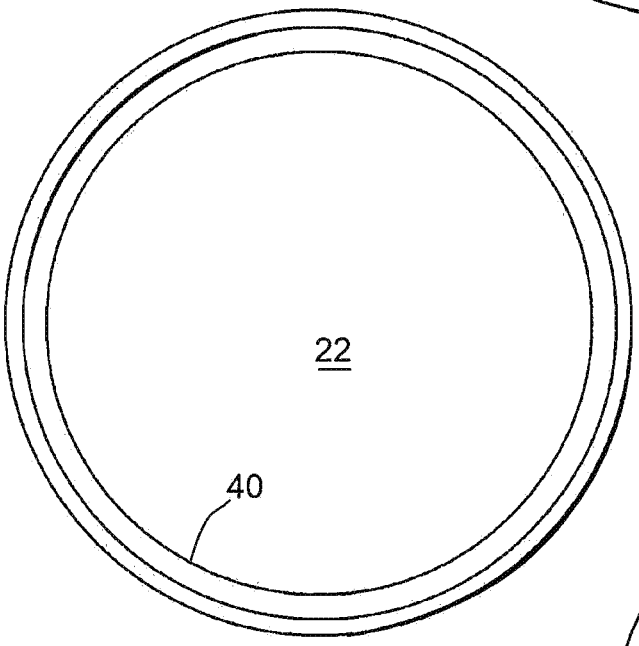
FIG. 4 shows a bottom plan view of the lid prior to removing of the tear strip shown in FIG. 3.
Figure 6:
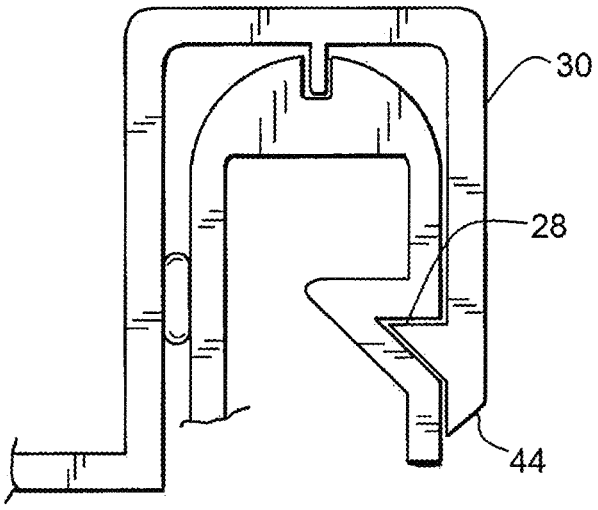
FIG. 6 shows a cross sectional view of detail A-A in FIG. 5.

FIG. 6 shows the downwardly extending wall 30 of the lid 22 broken at the line of demarcation 44 thus leaving thread 28 as part of the lid 22 but the hook 40 has been preferably at least partially, if not completely removed with the tearing off of the tear strip 42 such as by pulling the tab 43 as would be understood by those of ordinary skill in the art. Multiple sets of threads can be utilized such as is shown in FIG. 2 with threads 28,29 and others so that various starting positions could engage lid 22 relative to container 10. As may be understood by comparing FIG. 4 to FIG. 5, the threads 28,29 may be obscured from view by the hook 40 until the tear strip 42 is removed.

As one can see in reference to all the figures, the tear strip 42 with the hook 40 is preferably located below the threads 28,29 and/or others. The downwardly extending wall 30 of the lid 22 which forms a slot 38 with an upwardly extending wall 52 and is connected by a shoulder 54 which may be located above the internal center section 56 of the lid 22 for many embodiments. The internal surface 48 could be on a radially outwardly directed surface of upwardly extending wall 52. Thus the upwardly extending wall 52 and the downwardly extending wall 30 together with the shoulder 54 form somewhat of a channel or slot 38 for some embodiments. Other structure may be provided as well for various lid configurations. When pressing the lid 22 to the container 10, it is envisioned that the bottom end of lip 18 will be deflected inwardly.

Additionally, the extension 36 of the lid 22 is shown and received in the groove 34 for at least some embodiments forming a first seal. This may not be necessary for all embodiments. The groove 34 can be located at an upper surface of the upper end 16 of the container 10 and the extension 36 can be located at a bottom surface of the shoulder 54 for at least some embodiments. Other embodiments may be constructed differently. This feature may provide enhanced sealing for at least some embodiments if utilized.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An open ended container with lid combination comprising:

a container having an upwardly extending wall terminating at an upper end connected by a lip to a downwardly extending wall spaced radially outwardly of the upwardly extending wall by a slot, a thread channel formed into the downwardly extending wall;

a lid having a downwardly extending perimeter wall having inwardly directed threads which cooperate with the thread channel, thereby allowing the lid to rotate in a first direction into a closed configuration and rotate in a second direction opposite the first direction to an open configuration;

wherein the downward extending perimeter wall has a tamper indicator located below the threads, said tamper indicator having a hook, said hook having an upper surface contacting a bottom terminal edge of the downwardly extending wall of the container thereby preventing rotation in the second direction until the tamper indicator is removed from the lid in the tamper indicating configuration.

2. The open ended container with lid combination of claim 1 wherein when initially installing the lid on the container, the lid is pressed onto the container with the threads and the hook being radially displaced outwardly and then resiliently returning to the tamper indication when the threads engage the thread channel and the hook engages the bottom edge of the downwardly extending wall of the container.

3. The open ended container with lid combination of claim 2 wherein the threads have an angled surface on a bottom surface of the threads thereby directing the threads radially outwardly upon contact with the downwardly extending wall of the container.

4. The open ended container with lid combination of claim 3 wherein the hook has an angled surface on a bottom surface of the hook thereby directing the hook radially outwardly upon contact with the downwardly extending wall of the container.

5. The open ended container with lid combination of claim 2 wherein the hook has an angled surface on a bottom surface of the hook thereby directing the hook radially outwardly upon contact with the downwardly extending wall of the container.

6. The open ended container with lid combination of claim 1 wherein the tamper indicator provides the hook on a tear strip located below the threads on the lid, and removal of the tear strip disengages the hook from the container, thereby permitting rotation of the lid in the second direction.

7. The open ended container with lid combination of claim 6 further comprising a tab on the tear strip allowing the user to grab the tab and remove the tear strip at a line of demarcation located below the threads.

8. The open ended container with lid combination of claim 1 further comprising a gasket contacting the lid and the container in the shut configuration, said gasket at least assisting in providing a seal sealing in the contents of the container.

9. The open ended container with lid combination of claim 8 wherein the gasket is compressed radially with the closing of the lid relative to the container toward the closed configuration from the open configuration.

10. The open ended container with lid combination of claim 9 wherein the lid further comprises an upwardly extending wall spaced by a shoulder to the downwardly extending wall of the lid and the upwardly extending wall contacts the gasket in the closed configuration.

11. The open ended container with lid combination of claim 10 wherein the gasket is connected to an interior surface of the upwardly extending wall of the container.

12. The open ended container with lid combination of claim 1 wherein the thread channel on the downwardly extending wall of the container are space by a gap from the upwardly extending wall of the container.

13. The open ended container with lid combination of claim 12 further comprising a lip connecting the upwardly extending wall of the container with the downwardly extending wall of the container.

14. The open ended container with lid combination of claim 13 wherein the lip is located at an upper open end of the container.

15. The open ended container with lid combination of claim 14 wherein the lip has an upwardly directed groove, said groove assisting in forming a seal with the lid when in the closed configuration.

16. The open ended container with lid combination of claim 15 wherein the lid has an extension downwardly extending from a shoulder connected to the downwardly extending wall of the lid, said extension at least partially received in the groove thereby at least assisting in forming a seal with the container in the closed configuration.

17. The open ended container and lid combination of claim 16 wherein the shoulder connects an upwardly extending wall of the lid to the downwardly extending wall of the lid.

18. The open ended container and lid combination of claim 1 further comprising a lip having an upwardly directed groove, said lip connecting the upwardly extending wall of the container with the downwardly extending wall of the container, said groove assisting in forming a seal with the lid when in the closed configuration.

19. The open ended container and lid combination of claim 18 wherein the lid has an extension downwardly extending from a shoulder connected to the downwardly extending wall of the lid, said extension at least partially received in the groove thereby at least assisting in forming a seal with the container in the closed configuration.

* * * * *